US006093005A

United States Patent [19]

Nakamura

[11] Patent Number: 6,093,005

[45] Date of Patent: Jul. 25, 2000

[54] SCROLL-TYPE FLUID DISPLACEMENT MACHINE

[75] Inventor: Kimie Nakamura, Yamaguchi, Japan

[73] Assignee: Asuka Japan Co., Ltd., Yamaguchi, Japan

[21] Appl. No.: 09/096,452

[22] Filed: Jun. 11, 1998

[30] Foreign Application Priority Data

Sep. 12, 1997 [JP] Japan ..... 9-289035

[51] Int. Cl.[7] ..... F04C 18/00

[52] U.S. Cl. ..... 418/55.1; 418/55.3; 418/55.2; 418/55.4; 418/101

[58] Field of Search ..... 418/55.1, 55.2, 418/55.3, 55.4, 101

[56] References Cited

U.S. PATENT DOCUMENTS 2,475,247 7/1949 Mikulasek .
5,024,589 6/1991 Jetzer et al. ..... 418/55.3
5,842,843 12/1998 Haga ..... 418/55.2

FOREIGN PATENT DOCUMENTS 0 777 053 A1 6/1997 European Pat. Off. .

*Primary Examiner*—Thomas Denion
*Assistant Examiner*—Thai-Ba Trieu
*Attorney, Agent, or Firm*—McDermott, Will & Emery

[57] ABSTRACT

A scroll-type fluid displacement machine includes first and second scroll bodies that rotate synchronously together, their rotation axes being offset from one another. A cylindrical partition wall is provided to extend axially in the center of the scroll bodies. A space is provided between scroll vanes of the scroll bodies and the cylindrical partition wall. The interior of the cylindrical partition wall is cooled by air ventilation, and a grease-lubricated Oldham coupling is disposed inside the cylindrical partition wall. Hence, the Oldham coupling that is made of a metal is prevented from wear and deformation thereof over a long time. The displacement machine requires neither a counterweight nor a pin-crank device. The machine may be oil-free in the fluid compression part of the scroll bodies.

5 Claims, 7 Drawing Sheets

( 90° turned )

( 180° turned )

( 360° turned )

( 270° turned )

FIG. 8A
PRIOR ART
( 90° turned )
FIG. 8B
PRIOR ART
( 180° turned )
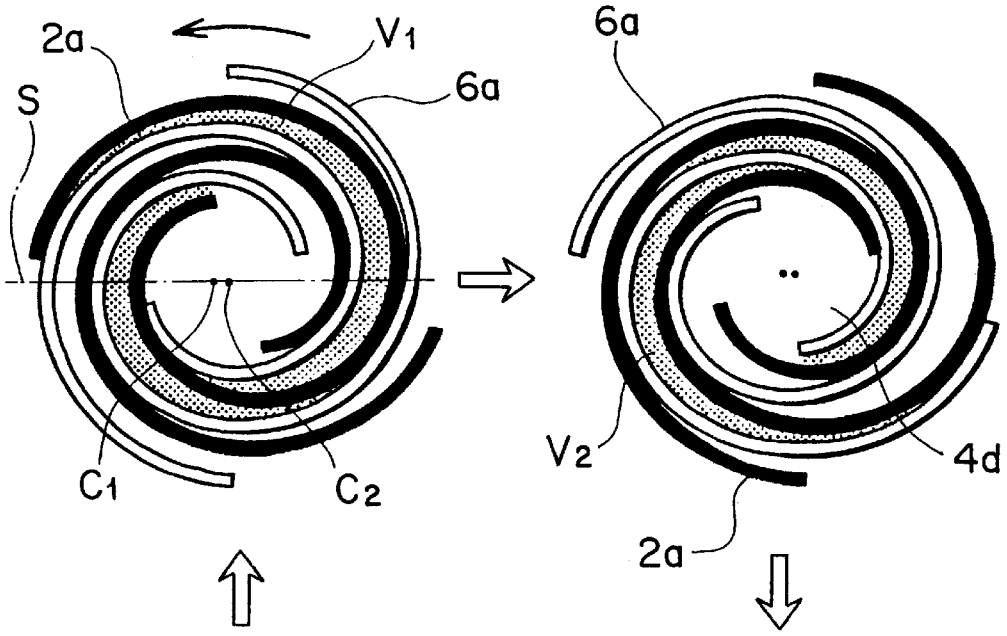
FIG. 8D
PRIOR ART
( 360° turned )
FIG. 8C
PRIOR ART
( 270° turned )
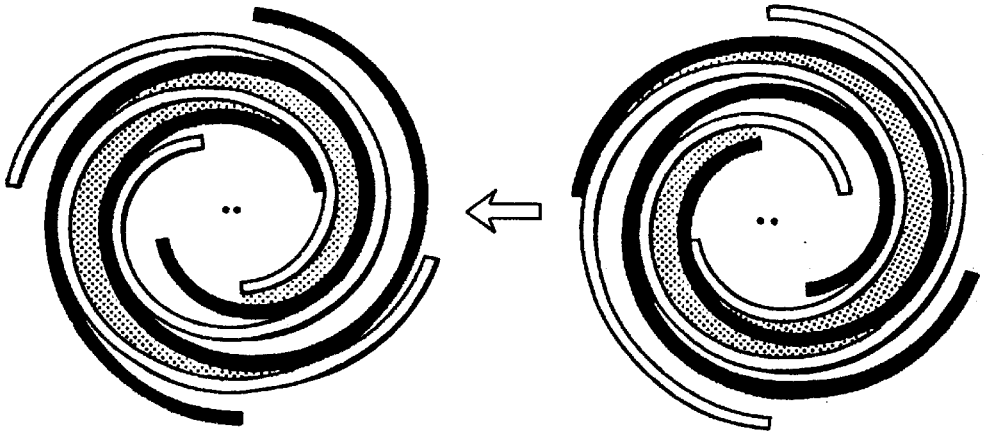

SCROLL-TYPE FLUID DISPLACEMENT MACHINE

BACKGROUND OF THE INVENTION

1. Field of the Invention

The present invention relates to a scroll-type fluid displacement machine having a pair of rotating scroll bodies, which is used as a blower or a vacuum pump.

2. Prior Art

A known scroll-type fluid displacement machine has a pair of scroll bodies that rotate respectively around each central axis. The central axes are offset from one another. Scroll (spiral) vanes of one of the scroll bodies are angularly shifted from scroll vanes of the other scroll body. Such constructed vanes define compression chambers one after another, which are moved and lessened to compress the enclosed fluid when the pair of scroll bodies rotate synchronously.

In a first type of such displacement machines, which is most commonly used, one of the scroll bodies is driven by a prime mover, while the other scroll body is rotated by friction, since scroll vanes of the other scroll body contact with scroll vanes and a side plate of the one of scroll bodies.

In a second type of the displacement machines, there is provided a synchronous rotation mechanism having arms each connected to an outer periphery of a pair of scroll bodies and also an Oldham coupling associated with the arms for synchronously rotating the scroll bodies.

In a third type of the displacement machines, there is disposed an Oldham coupling around central axes of the scroll bodies for synchronously rotating the scroll bodies. The Oldham coupling may be supplied with lubricating oil or may be oil-free.

The first and second types of displacement machines drive the secondary scroll body by the frictional contact of the scroll vanes or of the synchronous rotation mechanism, which wears the scroll vanes or the rotation mechanism and generates a large metallic noise due to the frictional contact. In addition, these constructions require to supply lubricating oil to the friction parts.

In the third type of displacement machines, the Oldham coupling is positioned in a space around the center axes of the scroll bodies. The space is heated up by a high fluid temperature in an adjacent compression chamber of a high compression rate. Accordingly, the oil-supplied Oldham coupling may suffer sticking due to vaporizing of the lubricating oil or by thermal expansion of a torque transmission disc and shaft coupling members. Meanwhile, an oil-free Oldham coupling must be made of a material having a better performance in self-sliding capability, high-temperature resistance, and wear resistance when used in a continuous operation of the machine. It is difficult to get such materials.

Moreover, it has been desired that the pair of scroll vanes are of an oil-free type and do not contact with one another.

SUMMARY OF THE INVENTION

To solve the aforementioned problem, a first configuration of the invention includes:

a first scroll body, a second scroll body, a cylindrical partition wall provided to extend axially in the center of the first scroll body, a space provided between the scroll vanes and the cylindrical partition wall to define an end compression chamber, and an outlet port opened to the space and provided in one of the end plates of the first and second scroll bodies.

A second configuration of the invention is further characterized in that the cylindrical partition wall has a seal ring provided at the tip thereof to slidably abut against one of the end plate axially opposed to the cylindrical partition wall thereby to seal the interior of the cylindrical partition wall from the end compression chamber, and the interior of the cylindrical partition wall communicates with a pair of air cooling vent passages.

A third configuration of the invention is additionally characterized in that an axial vent fan is provided for venting the interior of the cylindrical partition wall.

A fourth configuration of the invention is additionally characterized in that an Oldham coupling (radially slidable coupling) lubricated by grease is provided within the cylindrical partition wall to rotate the first and second scroll bodies in a complete synchronized relation.

A fifth configuration of the invention is additionally characterized in that the first and second scroll vanes to define the compression chamber have a minimum clearance larger than a predetermined value therebetween so as not to contact with one another.

Operational effects of the above-described configurations of the invention will be discussed hereinafter.

In a known configuration as shown in FIG. 8, a pair of scroll vanes 2*a*, 6*a* define a compression chamber near the rotation center axis, causing a central space 4*d* to be in a high temperature condition.

Meanwhile, in the present invention, there is provided a cylindrical partition wall in a central part of the scroll machine to define an end compression chamber around the outer surface of the cylindrical wall. In addition, the interior of the cylindrical wall is sealed to be separated from the compression scroll side and vented to the atmosphere for cooling. Preferably, an axial fan is provided to vent the interior of the cylindrical wall for enhancing the cooling. An Oldham coupling provided within the cylindrical partition wall and having a torque transmission disc and shaft coupling members, which are generally made of a metal, can rotate in a low-temperature surrounding air, allowing a normal grease lubrication thereof. This causes neither wear nor thermal expansion of the Oldham coupling mechanism. Furthermore, the pair of eccentrically disposed scroll bodies can rotate synchronously with no backlash.

In addition, the first and second scroll vanes can maintain a correct relative relation in their positions during the rotation to surely keep the minimum clearance therebetween.

BRIEF DESCRIPTION OF THE DRAWINGS

FIGS. 8A to 8D are explanatory illustrations showing sequential overlap states of scroll vanes of a known scroll-type fluid displacement machine.

DETAILED DESCRIPTION OF PREFERRED EMBODIMENTS

Figure 1:
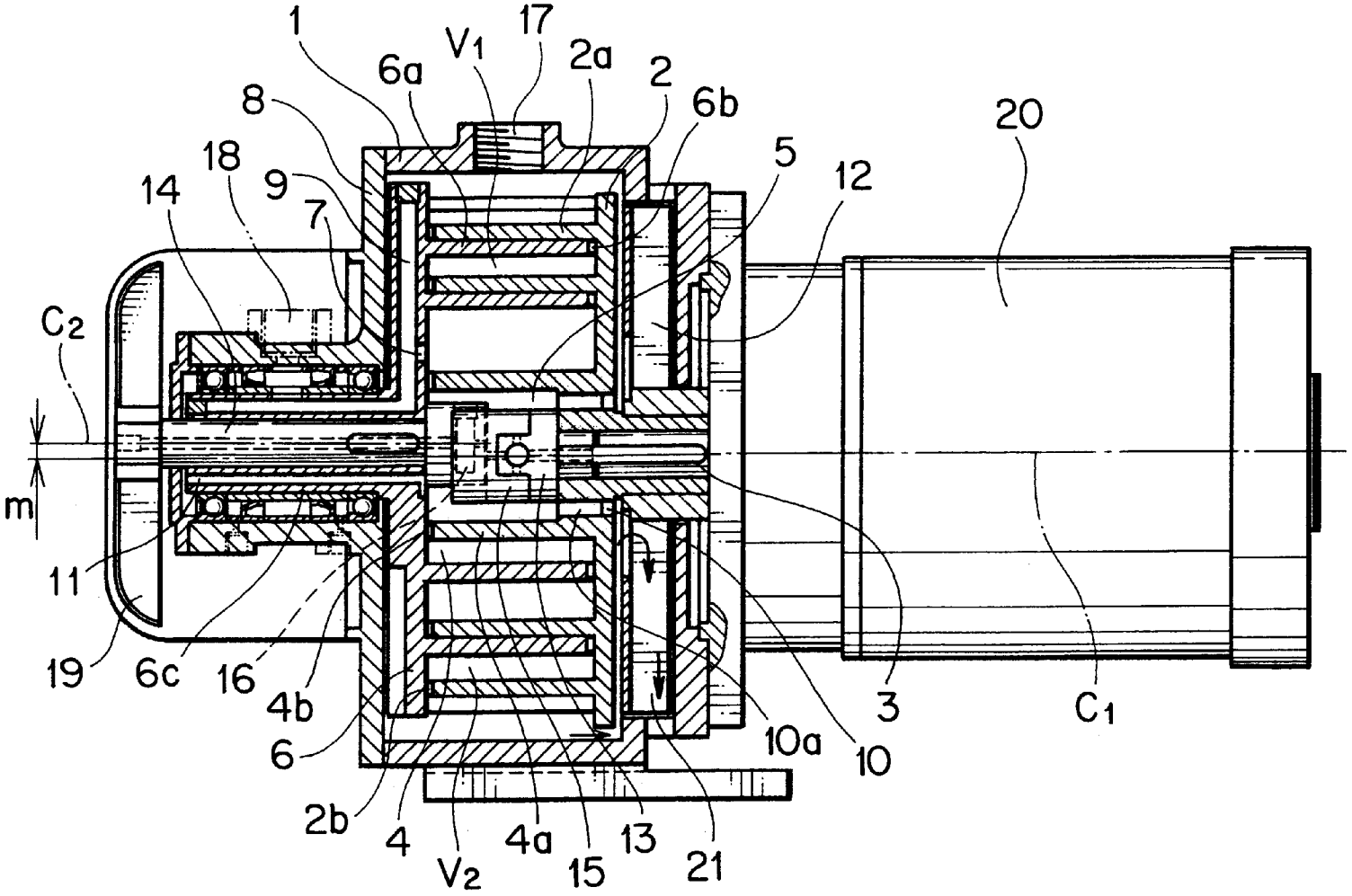
FIG. 1 is a sectional view showing a general arrangement of a scroll-type fluid displacement machine that has a pair of rotating scroll bodies.

Referring to FIGS. 1 to 7, an embodiment of the invention will be discussed hereinafter. FIG. 1 shows a scroll-type blower that is a fluid displacement machine having a pair of rotating scroll bodies. A first scroll body 2 is apart by an eccentric distance m from a second scroll body 6. First and second scroll vanes 2*a*, 6*a* respectively formed in one of the first and second scroll bodies partially overlap one another to define compression chambers $V_1$, $V_2$. Synchronous rotation of the pair of scroll bodies draws fluid from an inlet port 17, and ensmalls the compression chambers moving from the outer periphery toward the center part of the scroll bodies. An end compression chamber 4 is defined in a space surrounding a cylindrical partition wall 4*a* that is provided in a central part of the scroll body 2. A seal ring 4*b* seals the interior 5 of the cylindrical wall 4*a* from the end compression chamber 4. The compressed fluid is discharged from a delivery opening 18 through outlet ports 7, 9 of the second scroll body 6. A prime mover shaft 3 engages with a recess formed in a shaft boss of the first scroll body 2 by press fit. The center axis C1 of the first scroll body 2 aligns with the axis of the prime mover shaft 3. A shaft of the first scroll body 2 rotatively engages with a bearing fitted in a housing 1 of the displacement machine. A shaft boss 6*c* of the second scroll body 6 rotatively engages with a side cover 8 of the displacement machine by way of a bearing with an oil seal. The center axis C2 of the second scroll body 6 aligns with the bearing of the side cover 8. In this embodiment, the cylindrical partition wall 4*a* is fitted on the first scroll body 2, but may be alternatively fitted on the second scroll body 6.

To synchronously rotate the pair of scroll bodies 2, 6, there is provided an Oldham coupling. The Oldham coupling has a first driving hub 13, a second driving hub 14, and a torque transmission disc 15. The first driving hub 13 engages with the first scroll body 2 to align with the center axis C1 of the first scroll body 2. The second driving hub 14 engages with the second scroll body 6 to align with the center axis C2 of the second scroll body 6. The torque transmission disc 15 is disposed between the first driving hub 13 and the second driving hub 14 to sidably couple with the hubs 13, 14. The hubs 13, 14 have respectively a grease well to lubricate a rectangular groove formed in the torque transmission disc 15. Grease is supplied through a passage opened to one end of the machine. In the same end of the machine, there is provided a cooling fan 19. The center axis C1 is offset from the center axis C2 by an eccentric distance m. Such construction including the Oldham coupling allows to partially overlap the first scroll vane 2*a* and the second scroll vane 6*a* to define compression chambers during operation of the machine. The offset distance m is determined according to pitches, thicknesses, and the number of the scroll vanes. The tip portions of the scroll vanes are sealed against an end plate of each opposed scroll body with a tip seal ring 2*b* or 6*b*.

For cooling the first scroll body 2, there is provided a sirocco fan 12 that intakes air from an air passage 11 to deliver it into the inside of the cylindrical partition wall 4*a* and to discharge it from a vent passage 10, as shown arrows 21. Meanwhile, another cooling fan 19 is provided to cool the second scroll body side.

Figure 2:
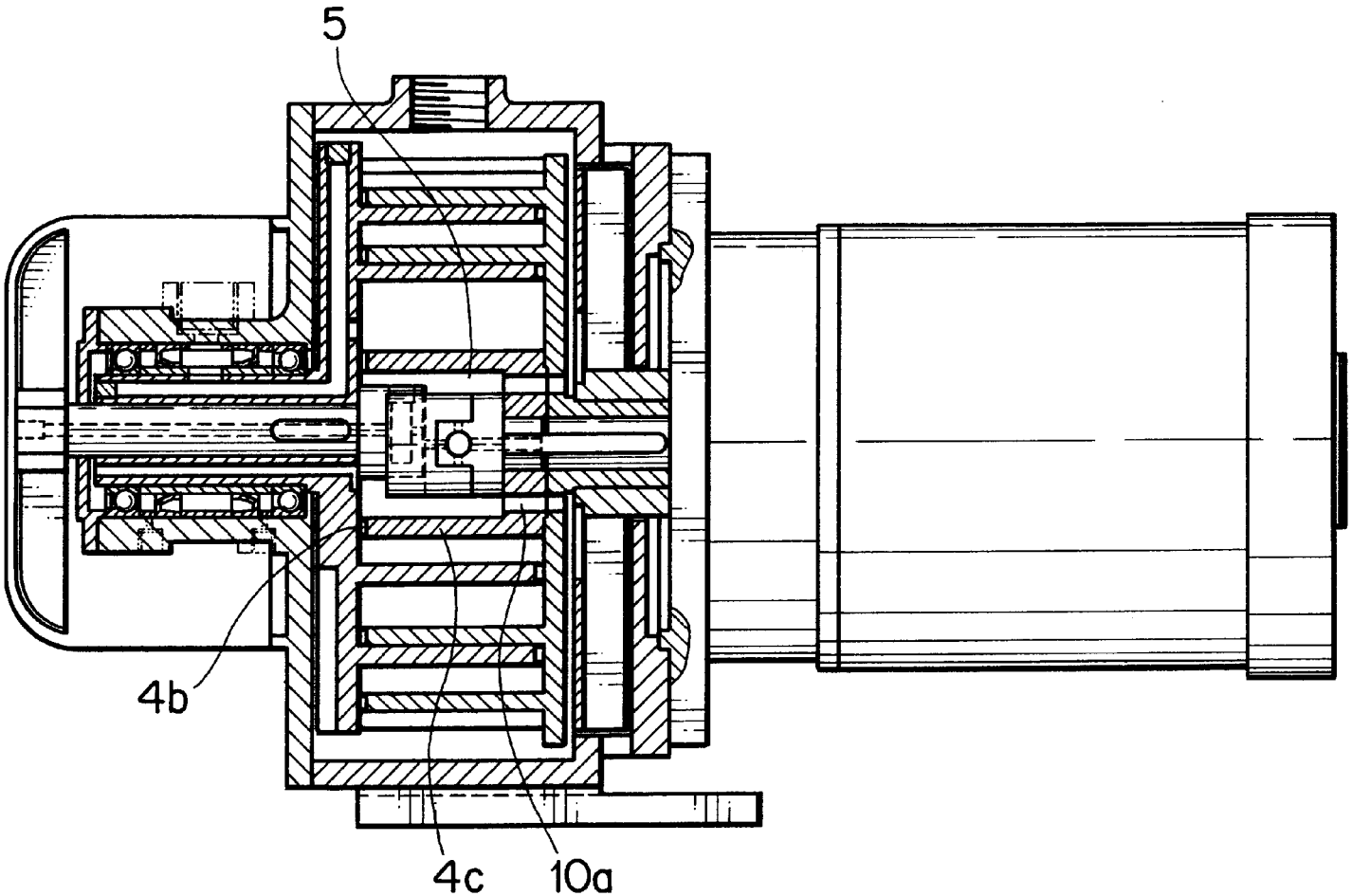
FIG. 2 is a sectional view showing a general arrangement of another scroll-type fluid displacement machine that has a pair of rotating scroll bodies with a cylindrical partition wall mounted between the pair of scroll bodies.
Figure 3A:
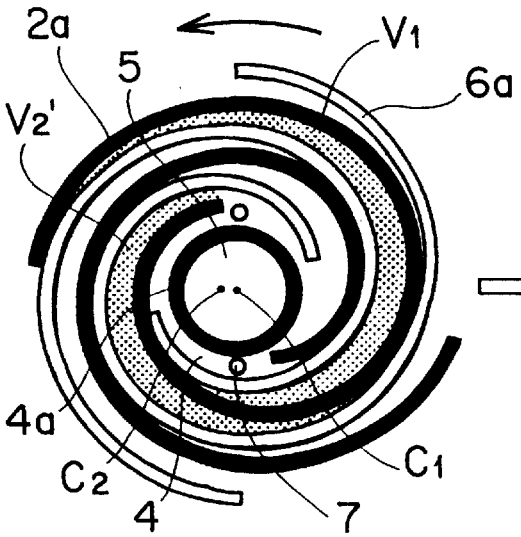
FIGS. 3A to 3D are explanatory illustrations showing sequential overlap states of scroll vanes of the displacement machines.
Figure 3B:
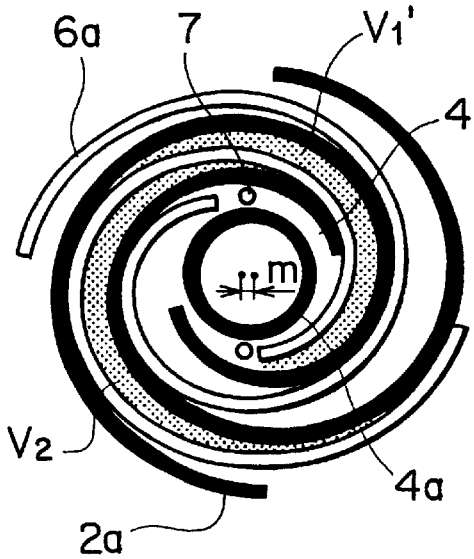
Figure 3D:
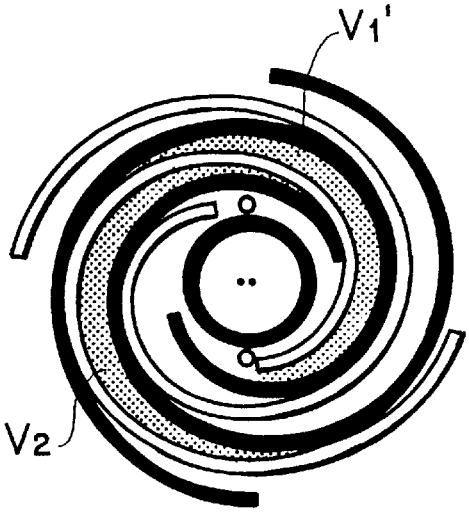
Figure 3C:
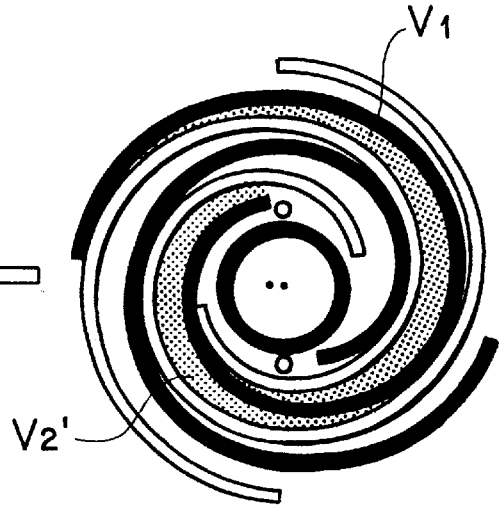
Figure 4:
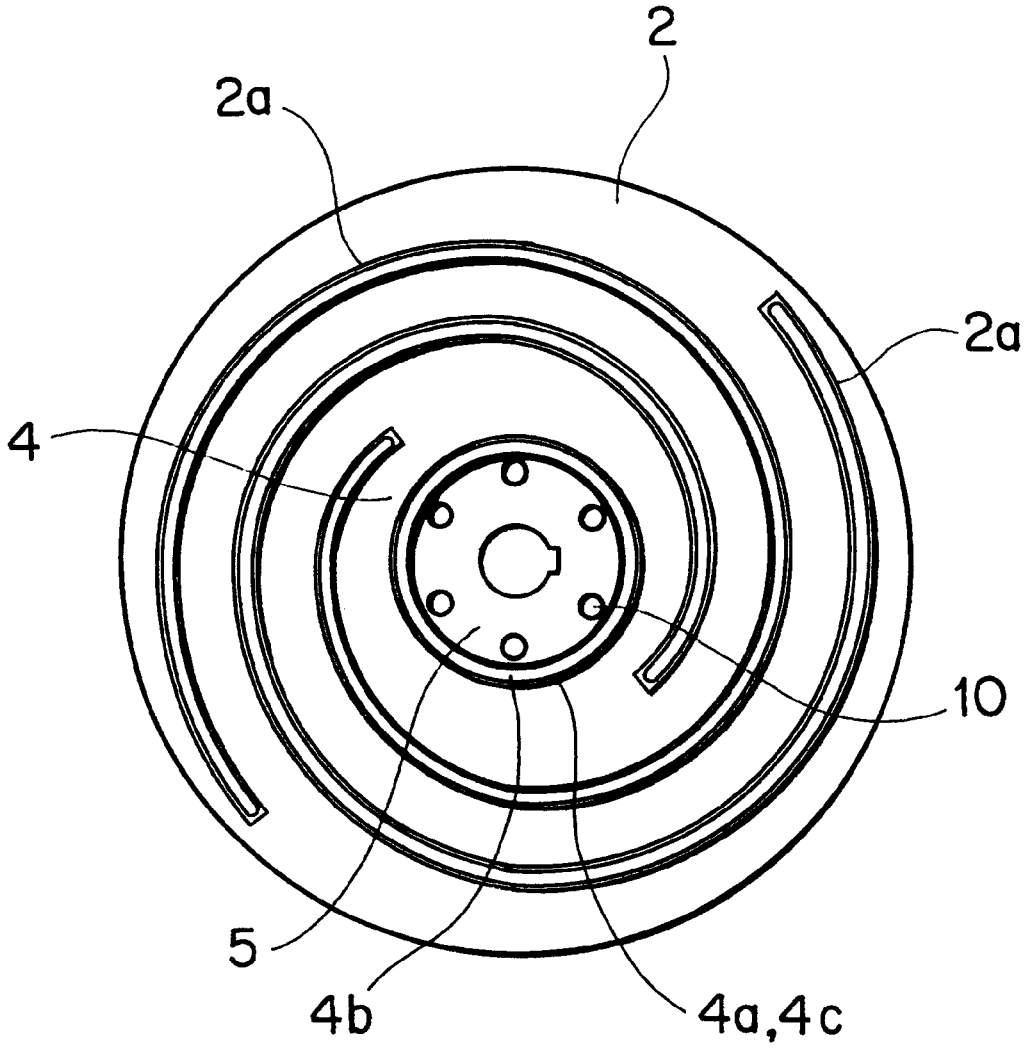
FIG. 4 is a front view of scroll vanes of the displacement machines.

FIG. 2 shows another embodiment in which a cylindrical partition wall 4*c* is not integrally formed with a scroll body but is independently formed so that it is disposed between a pair of scroll bodies.

Referring to FIG. 3, operation of the Oldham coupling and of synchronous rotation of the pair of scroll bodies 2, 6 will be discussed hereinafter. The pair of scroll bodies 2, 6 rotate in a direction shown by an arrow such that a second scroll vane 6*a* follows a first scroll vane 2*a* with a phase difference of 90° (a 180° phase difference in the embodiment shown in FIG. 2). FIG. 3A shows a quarter turned state from a base state regarding the pair of scroll bodies 2, 6, in which a first scroll vane 2*a* has partially overlapped a second scroll vane 6*a* to define an enclosed compression chamber $V_1$. FIG. 3B shows a half turned state in which that a second scroll vanes 6*a* has partially overlapped with a first scroll vane 2*a* to define another enclosed compression chamber $V_2$. FIGS. 3C and 3D show respectively a three-quarter turned state or the base state of the scroll bodies, in which compression chamber $V_1$ or $V_2$ appears. Thus, four compression chambers appear every rotation of the pair of scroll bodies 2, 6. Fluid compressed by the overlapped scroll vanes reaches an end compression chamber 4 outside the cylindrical partition wall 4*a*. To complete this operation, the pair of scroll bodies 2, 6 also require to synchronously rotate at a common angular speed, which will be discussed in detail hereinafter.

Figure 7:
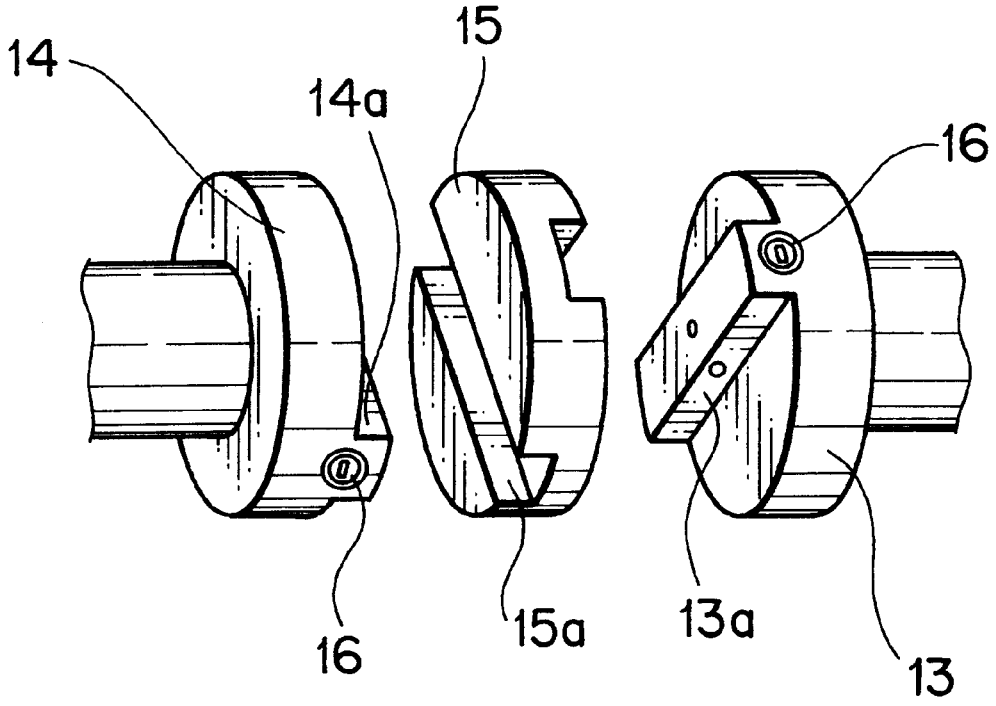
FIG. 7 is a perspective view showing an Oldham coupling including connection hubs and a torque transmission disc.

FIG. 7 shows the Oldham coupling having the first driving hub 13, the second driving hub 14, and the torque transmission disc 15. The driving hubs 13, 14 are respectively formed with a rectangular projection 13*a* or 14*a*. The rectangular projections 13*a*, 14*a* slidably engage respectively with one of rectangular grooves 15*a*, 15*a* respectively formed in one of the opposed sides of the torque transmission disc 15 with such an engagement tolerance as H6/g6. The pair of rectangular grooves 15*a*, 15*a* orient perpendicularly to one another, allowing a synchronous rotation of the scroll bodies with the offset distance m between the center axes C1, C2.

The hubs 13, 14 respectively have a grease well 16 that supplies grease into the associated groove 15*a* of the torque transmission disc 15. Hence, the connection parts of the Oldham coupling are prevented from wear or deformation. In addition, the torque transmission disc 15 is made of a metal having a high torque strength so that the pair of scroll bodies 2, 6 can rotate with no backlash. The rectangular projections 13*a*, 14*a* slide to reciprocate by the offset distance m once every rotation of the scroll bodies within the grooves 15*a* of the torque transmission disc 15, which generates little heat. Moreover, as shown in FIG. 1, the interior 5 of the cylindrical partition wall communicates with the vent passages 10, 11 to keep low in temperature, allowing a normal continuous operation of the Oldham coupling.

Figure 5:
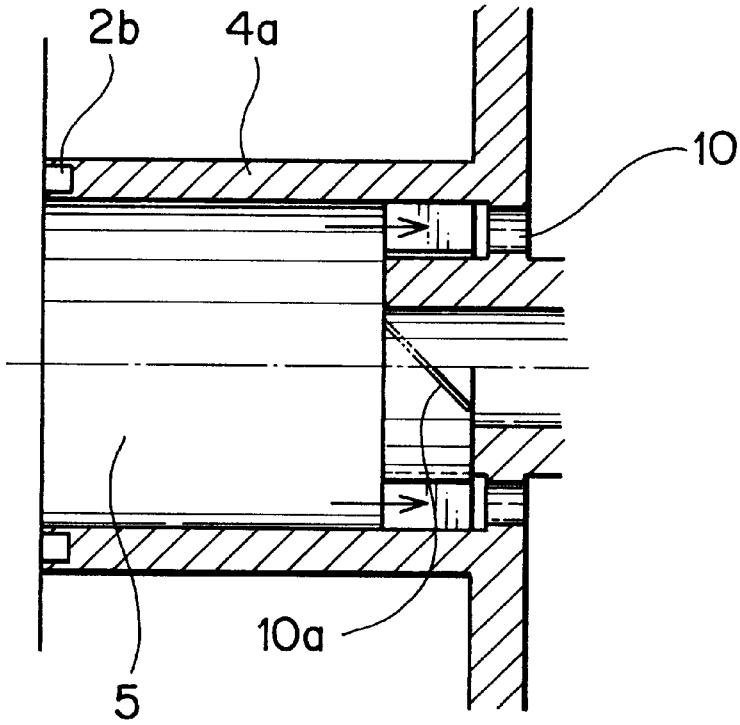
FIG. 5 is a side sectional view of the displacement machines including an axial fan mounted therein.
Figure 6:
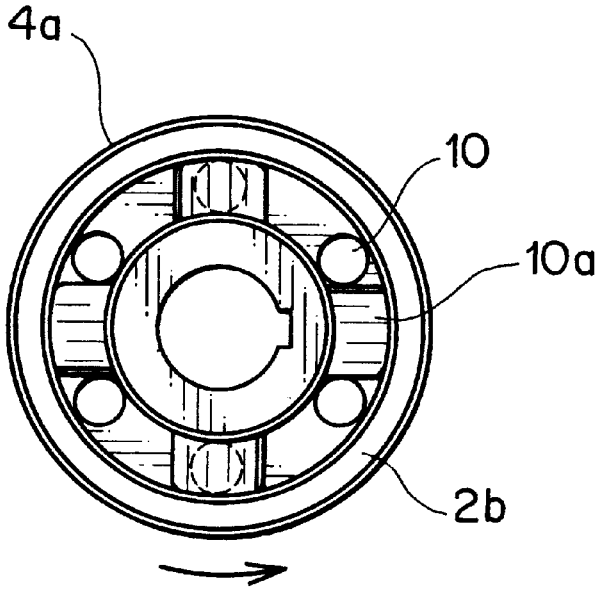
FIG. 6 is a front view of the mounted axial fan.

Moreover, as shown in FIGS. 5, 6, an axial fan 10*a* provided adjacent to the interior 5 of the cylindrical partition wall enhances the air cooling effect.

When the scroll machine is applied as a scroll-type vacuum pump, center bosses of the scroll bodies are rotatively sealed to be separated from the outside of the scroll bodies.

In addition, the present invention may be also applied to a single-vane-type scroll displacement machine having a pair of synchronous rotating scroll bodies.

Moreover, in the embodiments, the first and second scroll vanes have a common vane thickness and extend circumferencially in a common involute curve shape. The first and second scroll vanes may be angularly shifted from one another to keep a minimum clearance therebetween when rotated.

Next, operational effects of the present invention will be discussed hereinafter. In accordance with the invention, the cylindrical partition wall separates the compression chamber from the interior of the cylindrical partition wall, and the interior keeps low in temperature by the ventilation arrangement. Thus, grease used in the Oldham coupling members is not consumed, preventing wear and deformation of the coupling construction. Furthermore, this prevents a backlash in the Oldham coupling over a long time to keep a constant synchronous rotation of the pair of scroll bodies.

Moreover, the interior of the cylindrical partition wall is positively vented both by the sirocco fan provided in the side of the first scroll body and by the axial fan provided in the side of the second scroll body. Hence, the end compression chamber is cooled by way of the cylindrical partition wall, so that the fluid delivered is kept low in temperature.

In addition, since the Oldham coupling allows a stable synchronous rotation of the pair of scroll bodies, it may be possible to provide a minute clearance in overlapped parts of the pair of scroll vanes, which provides an oil-free scroll-type fluid displacement machine. Moreover, the Oldham coupling consists of a few elements, resulted in a low manufacturing cost with a precise construction.

What is claimed is:

1. A scroll-type fluid displacement machine comprising:

a housing, a side cover, a first scroll body, and a second scroll body, wherein said first scroll body rotates around a driving shaft center axis, said second scroll body rotates around an axis offset from said driving shaft center axis, said first and second scroll bodies are rotated synchronously with one another by a single prime mover, each of said first and second scroll bodies has an end plate and at least one circumferentially spirally extending scroll vane fitted on said end plate, said scroll vane of said first scroll body is disposed angularly deviated from said scroll vane of said second scroll body to define a compression chamber for displacing fluid from an outer periphery of said housing toward a center of the housing to compress the fluid, a cylindrical partition wall is provided to extend axially in the center of said housing, a space is provided between said scroll vanes and said cylindrical partition wall to define an end compression chamber, and an outlet port opened to said space is provided in one of said end plates of said first and second scroll bodies, wherein said first and second scroll bodies respectively have a central shaft, the central shafts being coupled to define an Oldham coupling such that the central shafts are offset from one another and rotate synchronously with each other.

2. A scroll-type fluid displacement machine as claimed in claim 1, wherein said cylindrical partition wall has a seal ring provided at the tip thereof to slidably abut against one of the end plates axially opposed to said cylindrical partition wall thereby to seal the interior of said cylindrical partition wall from said end compression chamber of said scroll bodies, and the interior of said cylindrical partition wall communicates with a pair of air cooling vent passages each provided in each end plate of said first and second scroll bodies.

3. A scroll-type fluid displacement machine as claimed in claim 1, wherein an axial vent fan is provided for venting the interior of said cylindrical partition wall.

4. A scroll-type fluid displacement machine as claimed in claim 1 wherein said Oldham coupling for synchronously rotating said central shafts has a grease well for lubricating said Oldham coupling.

5. A scroll-type fluid displacement machine as claimed in claim 1, wherein said first and second scroll vanes to define said compression chamber have a minimum clearance larger than a predetermined value therebetween so as not to contact with one another.

* * * * *